US005620626A

United States Patent [19]

Kim

[11] Patent Number: 5,620,626

[45] Date of Patent: Apr. 15, 1997

[54] METHOD FOR CONTROLLING READ-TIME OF A HUMIDITY SENSOR IN A MICROWAVE OVEN

[75] Inventor: Seong J. Kim, Incheon, Rep. of Korea

[73] Assignee: Daewoo Electronics Co., Ltd., Seoul, Rep. of Korea

[21] Appl. No.: 515,740

[22] Filed: Aug. 16, 1995

[30] Foreign Application Priority Data

Aug. 16, 1994 [KR] Rep. of Korea ..... 94-20167

[51] Int. Cl.[6] ..... H05B 6/68

[52] U.S. Cl. ..... 219/707; 219/702; 99/325

[58] Field of Search ..... 219/707, 705, 219/702, 712; 99/325; 73/29.01, 29.02, 335.02, 335.07

[56] References Cited

U.S. PATENT DOCUMENTS 4,518,839 5/1985 Taguchi et al. ..... 219/713
5,200,589 4/1993 Kim ..... 219/707
5,445,009 8/1995 Yang et al. ..... 219/707

FOREIGN PATENT DOCUMENTS 2917214 11/1979 Germany ..... 219/712

*Primary Examiner*—Philip H. Leung
*Attorney, Agent, or Firm*—Beveridge, DeGrandi, Weilacher & Young, L.L.P.

[57] ABSTRACT

Disclosed is a method capable of controlling read-time of a humidity sensor of a microwave oven so as to avoid interference by other parts in the microwave oven or exterior apparatuses, and thereby sensing an accurate humidity value in the microwave oven. In the method, the humidity sensing read time is determined in a rest section at which the oscillation of microwave by the magnetron is instantly interrupted, and thereby a safe and reliable humidity sensing value can be sensed.

5 Claims, 4 Drawing Sheets

METHOD FOR CONTROLLING READ-TIME OF A HUMIDITY SENSOR IN A MICROWAVE OVEN

BACKGROUND OF THE INVENTION

1. Field of the Invention

The present invention relates to a method for controlling read-time of a humidity sensor in a microwave oven, and more particularly to a method capable of controlling read-time of a humidity sensor in a microwave oven so as to avoid interference by other parts in the microwave oven, and thereby sensing an accurate humidity value in the microwave oven.

2. Description of the Prior Art

In general, automatic cooking methods used in the microwave oven are classified largely into a program type automatic cooking method and a sensor type automatic cooking method. According to the sensor type automatic cooking method, a humidity sensor and others in the microwave oven sense the humidity value of the moisture emitted from food put and heated in a heating chamber and other surrounding conditions such as temperature, and the cooking is controlled by automatic setting of the heating time according to the humidity sensing. Therefore, a great deal of research and development has been concentrated on the way to sense the humidity.

A conventional humidity sensing circuit used for a microwave oven as described above will be described hereinbelow with reference to the FIG. 1.

In FIG. 1, reference numerals 1, 2, 3, and 4 respectively designate a humidity sensing section for sensing humidity, an amplifying section for differentially amplifying the output of humidity sensing section 1, a microcomputer for outputting a control signal for controlling the humidity according to the amplified signal from amplifying section 2, and an equilibrium control section for controlling the equilibrium of humidity sensing section 1 according to the humidity control signal from microcomputer 3.

The humidity sensing circuit shown in FIG. 1 operates as follows.

At an initial stage of sensing the humidity, since an exact read-time for sensing humidity has not yet been set, microcomputer 3 sends an humidity control signal having a predetermined value through output terminals P0 through P4 and equilibrium control section 4 and thereby presets humidity sensing section 1.

Then, voltages of two nodes a and b of humidity sensing section 1 are inputted through non-inversion terminal and inversion terminal of an amplifier OPl of amplifying section 2 and then are differentially amplified. The amplified voltages are inputted through an humidity value input terminal A/D of microcomputer 3. In this case, the inputted voltages corresponding to the humidity value have analog forms, and are inputted into an analog/digital converter in microcomputer 3 and then converted to digital values.

However, such values as above are different from the practical humidity value. It is because, in a microwave oven, food is heated by a microwave generated by a magnetron installed in the microwave oven so that leakage of the microwave, which necessarily happens in the course of heating the food, has an effect on the humidity sensing performed by humidity sensing section 1.

Hereinafter, more detailed description about the above-mentioned leakage of the microwave will be given with reference to FIG. 2 for showing a general control circuit of a microwave oven in relation to the operation as described above.

As shown in FIG. 2, the control circuit of the microwave oven comprises a low voltage transformer 11 and a high voltage transformer 12 for elevating the voltage of the inputted electric power to a predetermined value, an amplifying section 13 connected to high voltage transformer 12 so as to amplify the elevated voltage, a magnetron for generating a microwave utilizing the voltage amplified in amplifying section 13 as a driving power, a power supply section 15 for supplying an electric power into a control circuit board using the voltage received from low voltage transformer 11, an interrupt signal generating section 16 for generating an interrupt signal according to the power supply from power supply section 15, an humidity sensing section 17 for sensing the humidity and an amplifying section 18 for amplifying the sensed humidity value, and a microcomputer 19 for generally controlling various parts in microwave oven according to signals received form interrupt signal generating section 16 and amplifying section 18.

When the control circuit of microwave oven is operated, an input power of 110/220 V and 60 Hz is firstly applied to high voltage transformer 12 according to the control by door switch and relay switches for driving the magnetron which are not shown. Then, a voltage elevated to about 2000 V is applied from the second windings of high voltage transformer 12 to amplifying section 18 having a high voltage condenser H.V.C. and a high voltage diode H.V.D. and then is doubled to about 4000 V. The doubled voltage is applied to magnetron 14 as a driving voltage so as to make magnetron 14 oscillate a microwave. At this time, since the electric current is interrupted during half-period die to the characteristic of the high voltage diode in amplifying section 18, an oscillation mode and a rest mode alternate corresponding to the frequency of the input power during the whole oscillation.

At the same time, the input power is supplied through low voltage transformer L.V.T. to power supply section 15 in the control circuit board, and power supply section 15 transforms the input power into a direct current power and then supplies the direct current power to microcomputer 19, humidity sensing section 17, and other load driving relays. The power supplied to microcomputer 19 passes through interrupt signal generating section 16 which applies an external interrupt signal as a pulse signal by a zero-crossing detection of frequency of an electric power of power supply section 15. Generally, interrupt signal generating section 16 is used in order for microcomputer 18 to determine whether the frequency of an electric power is a predetermined frequency such as 50 Hz or 60 Hz, or used for generating an interrupt signal for a specific abject such as time-count, in a conventional control circuit of a microwave oven.

As described above, in the conventional control circuit of the microwave oven, there is a possibility that the microwave oscillated in magnetron 14 leak and flow through wires and nodes into the circuit and then function as noise to the sensed humidity value.

To overcome the above described problem, various methods for minimizing the leakage of microwave have been proposed. An example of the methods is shown in FIG. 1 in which a plurality of noise-absorbing condenser C1 through C4 are connected to humidity sensing section 1 and amplifying section 2 so as to reduce the effect of the leakage of microwave.

However, just installation as such can not entirely remove the effect of the leakage of microwave. On the contrary, the voltage charged in the condensers can have bad effect on the sensed humidity value so as to cause the value more inaccurate. Further, the condensers necessarily invite increase in the number of parts of the circuit so as to make the circuit be more complicated.

Meanwhile, there is another method in which the humidity values are sensed several times and then a mean value of the sensed humidity values is adopted as a resultant sensed humidity value. However, neither this method can entirely remove bad effect by the leakage of microwave.

SUMMARY OF THE INVENTION

The present invention is intended to overcome the above-discussed and numerous other disadvantages and deficiencies of the prior art.

Therefore, it is an object of the present invention to provide a method for controlling read-time of an humidity sensor in the microwave oven by which the humidity value can be accurately sensed without being influenced by the leakage of microwave.

To achieve the above object, the present invention provides a method for controlling read-time of a humidity sensor of a microwave oven for cooking food using an oscillation of a magnetron, the method comprising the steps of:

(a) setting a first and a second points of time respectively having a first and a second predetermined phases in a period of a frequency of an electric power respectively as a first read time and a second read time, and then setting the first read time as a present read time;

(b) obtaining a mean value of humidity values sensed by reading humidities at every said present read time corresponding to external interrupts according to the frequency of the electric power;

(c) setting an initial mean value with respect to a presently set read time as a reference value, and then comparing whether a difference between the reference value and a following mean value is in a predetermined value;

(d) initializing the reference value and the mean value when the difference is larger than the predetermined value in step (c), and changing the read time from the first read time to the second read time, and then repeating the steps (b) and (c); and (e) determining the read time at the comparing step (c) as a humidity sensing read time when the difference is smaller than the predetermined value in step (c).

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE PREFERRED EMBODIMENTS

Hereinafter, a method for controlling read-time of an humidity sensor of a microwave oven according to the present invention will be described in detail with reference to the accompanying drawings.

In a humidity sensing circuit, a voltage elevated up to about 2000 V through a high voltage transformer is doubled to about 4000 V by an amplifying section having a high voltage condenser and a high voltage diode and then is applied to a magnetron as a main driving voltage of the magnetron, and an oscillation mode and a rest mode alternate corresponding to the frequency of input power such as 50 Hz or 60 Hz during the whole oscillation of the magnetron since the input power is interrupted during half-period thereof due to the characteristic of the high voltage diode in the amplifying section.

That a read-time can be safely determined by the present invention is based on such a characteristic. That is, in the rest mode at which the oscillation of microwave by the magnetron is instantly interrupted, the humidity value can be read without hindrance by the leakage of microwave.

Figure 1:
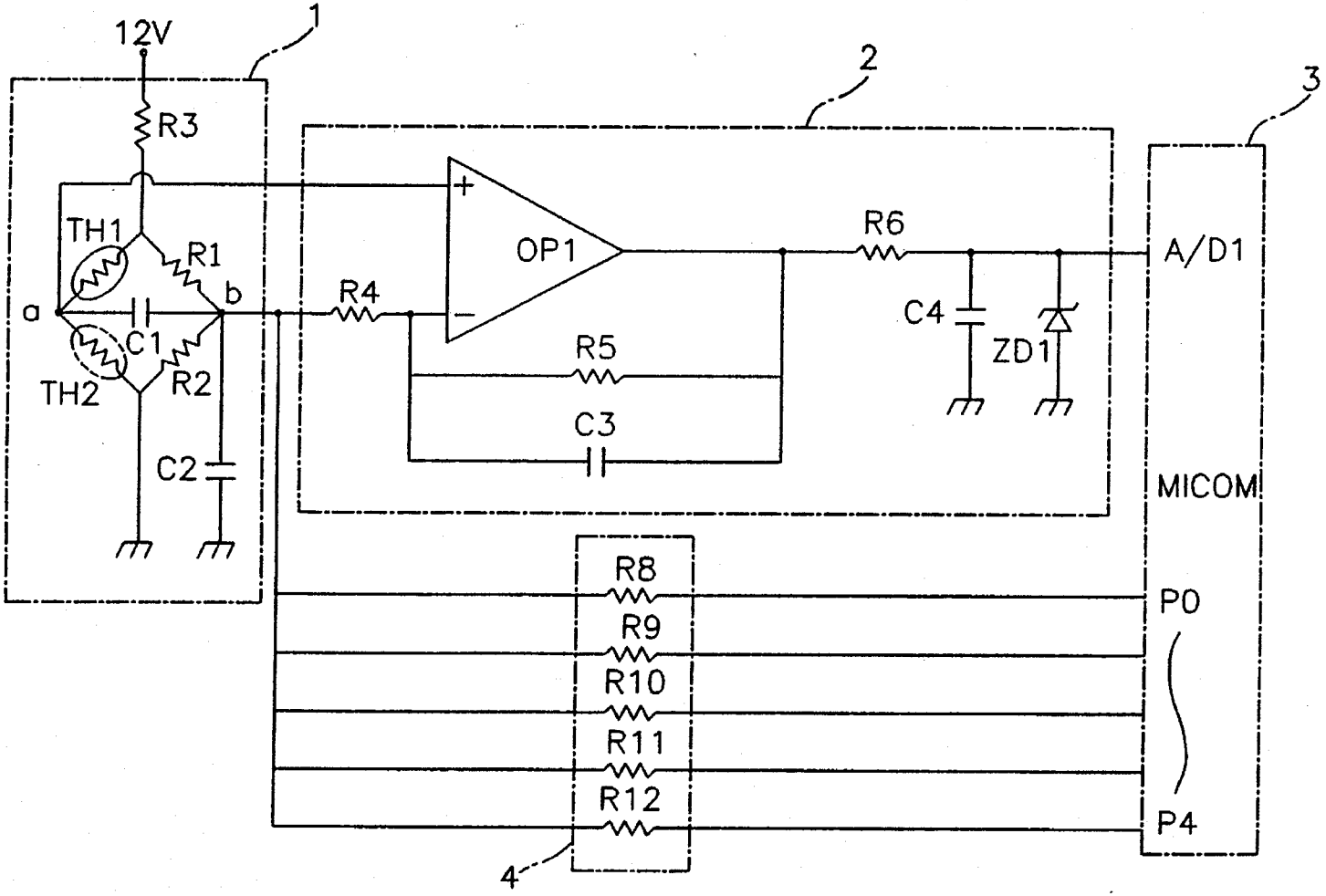
FIG. 1 PRIOR ART
FIG. 1 is of a conventional humidity sensing circuit diagram of a microwave oven.
Figure 2:
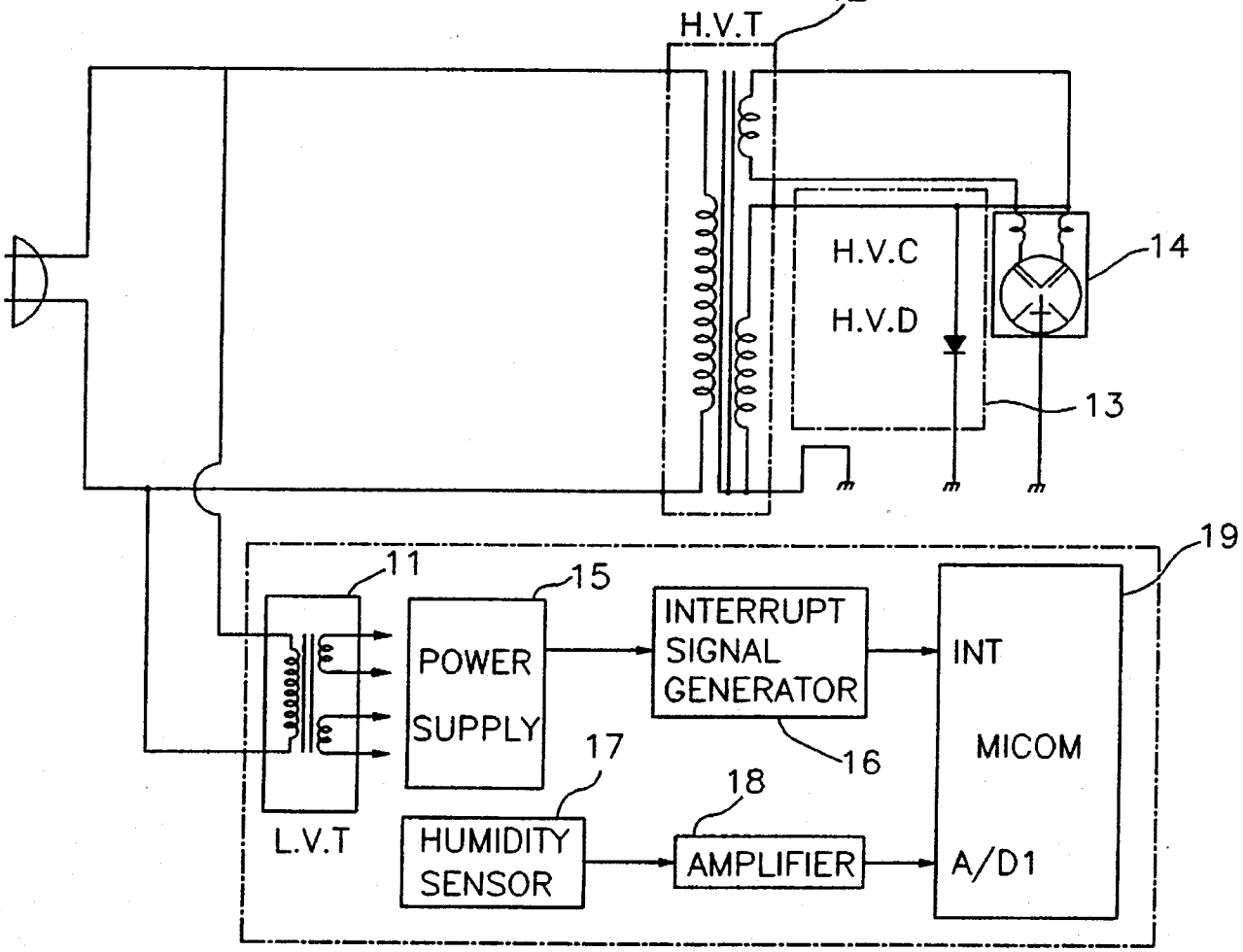
FIG. 2 PRIOR ART
FIG. 2 is a general control circuit diagram of a microwave oven.
Figure 3:
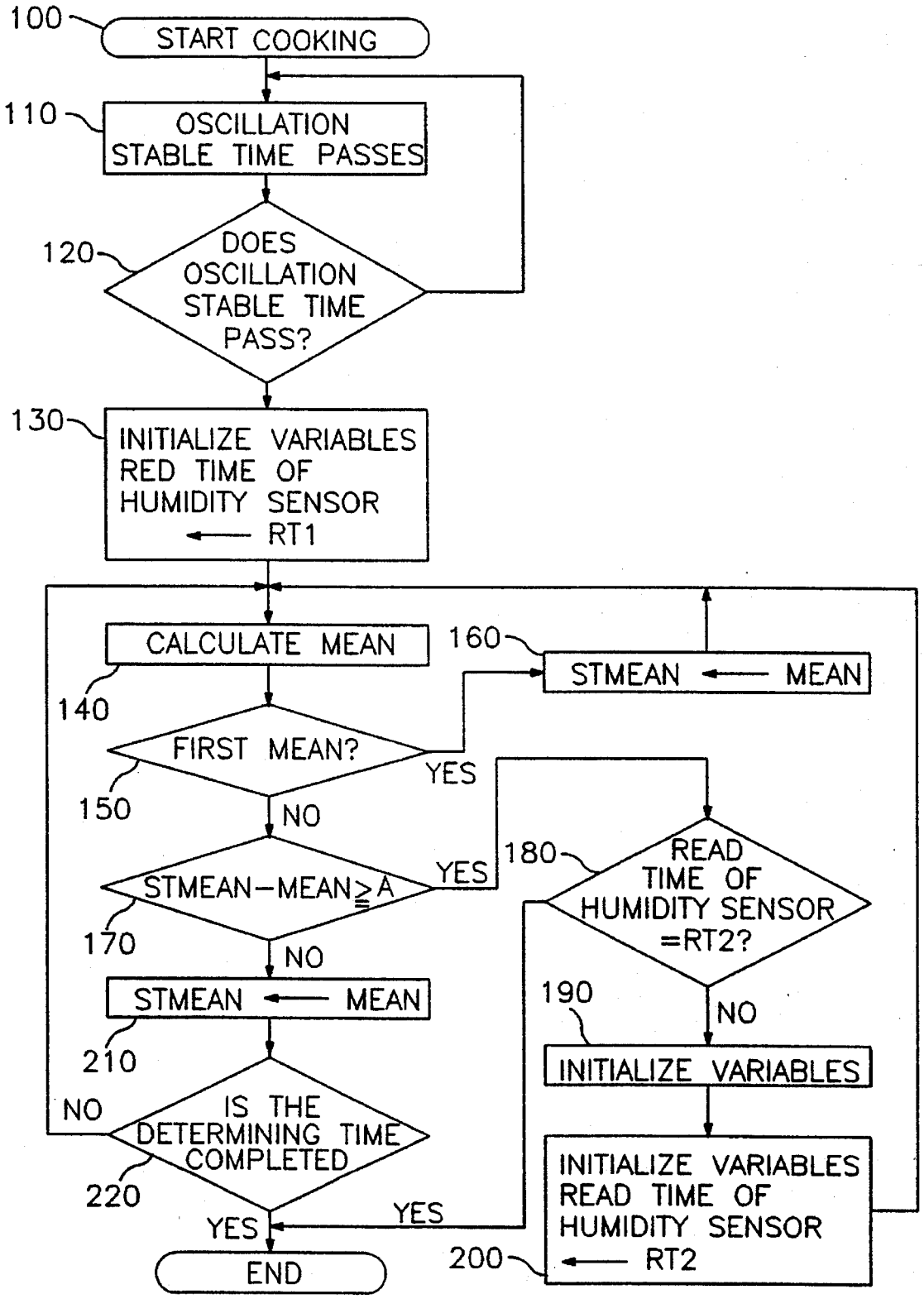
FIG. 3 is a flow chart for determining the read-time of an humidity sensor of a microwave oven according to the present invention.

Referring to the flow chart in FIG. 3, the method for controlling read-time according to the present invention based above point will be described hereinbelow.

Firstly, cooking of food is started according to conditions set by a user (step 100). After the cooking is started, a predetermined time for stabilizing the oscillation of the magnetron (about 1–2 seconds) is waited for (step 110).

The microcomputer checks whether the stabilizing time has passed at every predetermined time interval (step 120), and it proceeds to step 130 when the stabilizing time has passed.

In step 130, ¼ phase and ¾ phase in a period of a frequency of an electric power are respectively set as a first read time RT1 and a second read time RT2, and various variables such as mean value, reference value, and determining time are initialized. Moreover, whenever an external interrupt is happened according to the frequency of an electric power, a read time counter is cleared and then re-counting is performed. The external interrupt signal is a pulse signal the edge of which is the zero-crossing point of the input power, and the lowering edge is recognized as the interrupt.

Figures 4A, 4B, 4C:
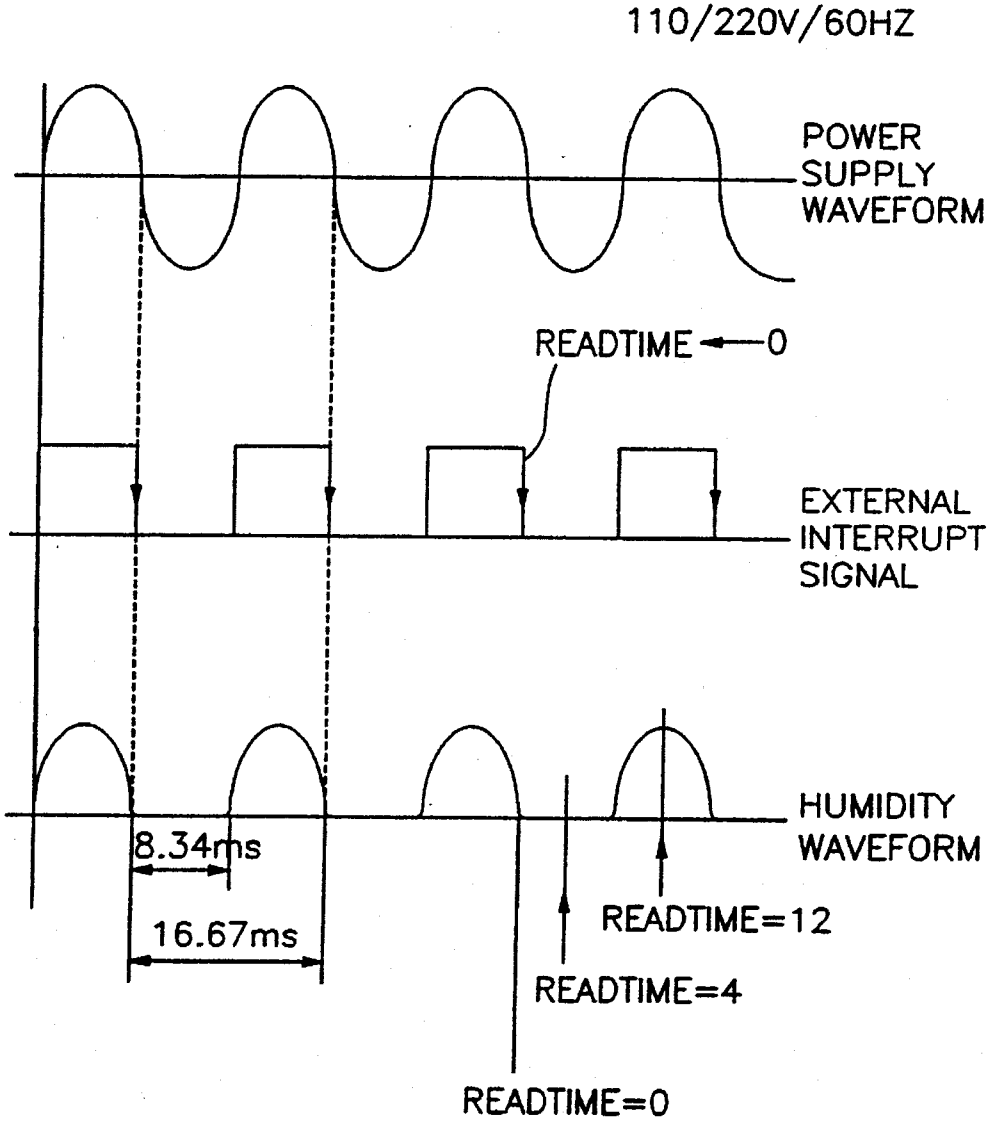
FIGS. 4A, 4B, and 4C respectively are wave form charts of a frequency of an electric power, an external interrupt signal and an output of a humidity sensor.

In this case, the red time counter is cleared when the external interrupt signal is at the lowering edge, and increases the counted value at every about 1.0 msec. When the frequency of an electric power is 60 Hz as shown in FIG. 4A in which one period is 16.67 msec, the first read time RT1 is set as a state the read time count is 4 msec which is ¼ phase and the second read time RT2 is set as a state the read time count is 12 msec.

As described above, whenever an external interrupt is happened, the read time counter is cleared and re-counting is performed while setting the first read time RT1 as a humidity sensor read time and reading the humidity value at every first read time RT1 according to the read time count and then obtaining a mean value of the humidity value at every predetermined number of times (step 140).

When the mean value is obtained, it is determined whether the obtained value is one-time mean value (step 150). This determination is necessary because the reference value has not yet been set at this stage. Therefore, if the mean value determined at stage 150 is the one-time mean value, it proceeds to step 160 and set the mean value obtained at stage 140 as the reference value and then returns to step 140.

Then, when a second-time mean value has been obtained at step 140, it goes to step 170 for comparing the mean value with the reference value because the mean value at step 150 is not the one-time mean value.

In step 170, it is determined whether the difference between the mean value and the reference value set by the initially obtained mean value is larger than a predetermined value A. As a result of the determination, if the difference is larger than the predetermined value, the measured result at the first read time indicates that the differences between the mean values at every measuring time are large, and thereby it is determined that the first read time includes noise, so that it proceeds to step 180.

In step 180 it is determined if the humidity sensor read time is equal to the second read time RT2. In the previous stage, the first read time was determined as having noise because the difference between the mean value and the reference value in the time set as the first read time was larger than a predetermined value, and accordingly the present time is reset as the second read time at the following stage if the present time was the first read time. However, the above step is finished if the reset second read time also includes noise.

In step 190 and step 200, to change the humidity sensor read time to the second read time instead of the existing first read time, values of variables such as reference value, mean value, number of times for reading the mean value, and determining time are cleared for initializing, and at the same time the humidity sensor read time is changed to the second read time RT2, and accordingly the mean value is obtained and the reference value is set and then the two values are compared to each other. The above process is repeated in the present steps.

However, when the difference between the mean value and the reference value is smaller than the predetermined value A in step 170, the reference value is renewed as the present value (step 210).

Meanwhile, though the process for determining the read time is performed in a very short time, the noise is generated not always in such a short at an initial stage of cooking. Accordingly, time of about 10 seconds is usually secured to determine the humidity sensing read time more preferably, and the preceding stages are continuously performed if this determining time has not passed (step 220).

Meanwhile, if the determining time has passed and there has been no error in the proceeded steps, the resultant determined humidity sensing read time is the exact humidity sensing read time.

As described above in detail, according to the present invention, whether there is noise-inclusion is determined by comparing the mean value with the reference value, and accordingly a lead time with no noise can be detected so that a rest section with no oscillation of microwave can be accurately detected. After the detection, the humidity sensor is preset, and the humidity sensing value is read and thereby the humidity is sensed according to the read time determined as described above by the external interrupt signal after the preset is completed.

Therefore, by the method of the present invention, since the read time is determined and the humidity value is read when the noise is not generated at all, the humidity value can be sensed without being influenced by the leakage of microwave, and thereby the preciseness of sensing the humidity is improved. Further, variance in cooking performance is reduced, so that the reliability on the microwave oven is elevated.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A method of controlling read-time of a humidity sensor of a microwave oven for cooking food using an oscillation of a magnetron, the method comprising the steps of:

(a) setting a first time and a second time respectively having a first phase and a second phase in each of half periods of a frequency of a power source of the microwave oven respectively as a first read time and a second read time, and then setting the first read time as a present read time;

(b) sensing humidity values at every said present read time according to an external interrupt signal generated in a zero-crossing point of a frequency signal of the power source and obtaining a mean value of said humidity values;

(c) setting an initial mean value with respect to a presently set read time as a reference value, and then comparing a difference between the reference value and a next mean value with a predetermined value;

(d) initializing the reference value and the mean value when the difference is larger than the predetermined value in step (c), and changing the read time from the first read time to the second read time, and then repeating the steps (b) and (c); and (e) determining the read time at the comparing step (c) as a humidity sensing read time when the difference is smaller than the predetermined value in step (c).

2. The method as claimed in claim 6, wherein the steps (b) through (e) are repeated until a predetermined determining time has passed.

3. The method as claimed in claim 1, wherein the first read time and the second read time in step (a) respectively have ¼ phase and ¾ phase.

4. The method as claimed in claim 1, wherein the setting of the read time is accomplished at rest sections at which the oscillation of the magnetron is instantaneously interrupted.

5. The method as claimed in claim 1, wherein the step (a) further comprises a step of waiting for a predetermined oscillation-securing time, and the setting of the read time is accomplished after the waiting step.

* * * * *